US006541177B1

(12) United States Patent
Foley et al.

(10) Patent No.: US 6,541,177 B1
(45) Date of Patent: Apr. 1, 2003

(54) DIFFUSION TRANSFER PHOTOGRAPHIC FILM UNIT

(75) Inventors: James A. Foley, Wellesley, MA (US); Michael P. Filosa, Medfield, MA (US); Stephen J. Telfer, Arlington, MA (US); John L. Marshall, Lexington, MA (US); David P. Waller, Lexington, MA (US)

(73) Assignee: Polaroid Corporatiion, Waltham, MA (US)

( * ) Notice: Subject to any disclaimer, the term of this patent is extended or adjusted under 35 U.S.C. 154(b) by 0 days.

(21) Appl. No.: 09/835,651

(22) Filed: Apr. 16, 2001

(51) Int. Cl.[7] ..... G03C 8/06; G03C 8/10; G03C 8/26; G03C 8/28; G03C 8/52

(52) U.S. Cl. ..... 430/207; 430/22; 430/212; 430/220; 430/221; 430/222; 430/227; 430/241; 430/244; 430/952

(58) Field of Search ..... 430/22, 207, 221, 430/222, 227, 10, 212, 241, 244, 952

(56) References Cited

U.S. PATENT DOCUMENTS

| | | | | | |
|---|---|---|---|---|---|
| 3,647,437 | A | * | 3/1972 | Land | 430/221 |
| 3,702,244 | A | | 11/1972 | Bloom et al. | 96/3 |
| 3,702,245 | A | | 11/1972 | Simon et al. | 96/3 |
| 3,726,675 | A | | 4/1973 | Borror | 96/3 |
| 4,139,381 | A | | 2/1979 | Bloom et al. | 96/3 |
| 4,178,446 | A | | 12/1979 | Bloom et al. | 544/33 |
| 4,178,447 | A | | 12/1979 | Borror et al. | 544/33 |
| 4,701,388 | A | * | 10/1987 | Yoshimura et al. | 430/207 |
| 5,142,311 | A | | 8/1992 | Olson et al. | 354/120 |

* cited by examiner

*Primary Examiner*—Richard L. Schilling

(57) ABSTRACT

A self-developing diffusion transfer photographic film unit which includes a latent image which becomes visible upon photographic processing of the film unit. The latent image is formed with a chemical compound such as an indicator dye and the visible image formed from the latent image as a result of photographic processing may be transient or permanent. Also described are diffusion transfer photographic methods.

16 Claims, No Drawings

DIFFUSION TRANSFER PHOTOGRAPHIC FILM UNIT

BACKGROUND OF THE INVENTION

This invention relates to diffusion transfer photographic film units and methods, and, more specifically, to such film units ,and methods which utilize them, which include a latent image which becomes visible upon photographic processing of the film unit.

There are known in the art diffusion transfer photographic film units which include latent images which become visible upon photographic processing of the film unit. U.S. Pat. No. 5,142,311 discloses such a film unit which has a first area exposed to light during manufacture of the film. Following exposure of a second area of the film unit to a subject while the first area is masked so as not to be further exposed and photographic processing of the film unit a composite image is formed comprised of the developed latent image and the image of the subject. The latent image may be any desired image.

As the state of the self-developing, diffusion transfer photographic art advances new uses are proposed for diffusion transfer film units generally and, in particular, film units which include a latent image. It would be desirable to have diffusion transfer photographic film units wherein the visible image obtained from a latent image as a result of photographic development may be transient or permanent. It would also be desirable to have diffusion transfer photographic film units which can provide composite images with only one exposure of the film unit.

SUMMARY OF THE INVENTION

These and other objects and advantages are accomplished in accordance with the invention by providing a self-developing diffusion transfer photographic film unit which includes a latent image formed by a chemical compound. The latent image is adapted to form a visible image upon photographic processing of the film unit. The visible image formed from the latent image may be transient, i.e., it will be visible for some period of time during and after photographic development but will then disappear, or permanent, i.e., a composite final image is obtained which includes a visible image corresponding to the latent image and an image of the subject of the exposure.

The latent image may be formed with any of various suitable chemical materials including, for example, indicator dyes, bleachable filter dyes and bleachable indicator dyes. The latent image may be disposed in any suitable location within the self-developing, diffusion transfer photographic film unit. It is preferred to arrange the latent image in the image-receiving element of the film unit.

The self-developing diffusion transfer film units of the invention may be "peel-apart" film units, i.e., those where the image receiving element is designed to be separated from the photosensitive element after the photosensitive element is exposed and photographic development is effected or "integral" film units, i.e., those where the photosensitive and the image-receiving elements are designed to be maintained together when image formation is completed. Further, the film units of the invention may be adapted to provide black and white or color, including multicolor, images.

There are also provided according to the invention diffusion transfer photographic methods for forming composite photographs with only a single exposure of a film unit.

DESCRIPTION OF THE PREFERRED EMBODIMENTS

The latent image incorporated in the self-developing, diffusion transfer photographic film units of the invention may be provided by any suitable chemical material which will provide a visible image, whether transient or permanent, during and after photographic development brought about by application of an aqueous alkaline photographic processing composition to the film unit. Typical suitable chemical materials which can be utilized to form the latent image include indicator dyes, bleachable filter dyes and bleachable indicator dyes. The latent image can be incorporated in the diffusion transfer film unit during the manufacture or assembly thereof. The latent image may be of any type including a greeting, advertising indicia, a vignette, a symbol or the like.

An indicator dye, generally speaking, is one which undergoes a reversible color change at different pH levels. It is well known to use indicator dyes in diffusion transfer photographic film units for the purpose of protecting a selectively exposed photosensitive material from post-exposure fogging in photographic methods where development is conducted in the presence of extraneous incident light such as is the case with integral diffusion transfer photographic film units which are ejected from the camera after exposure and application of a photographic processing composition such that development takes place in ambient light. See, for example, U.S. Pat. Nos. 3,702,244; 3,702,245 and 3,726,675. It is also well known that in the diffusion transfer photographic development process the pH of any particular location within the film unit varies with time. Typically, the aqueous alkaline processing composition employed in the development step has a very high pH, e.g., from about 13 to 14, and during development each layer of the multilayer film unit goes through a broad range of pH which includes very high pH levels and relatively low pH levels and ultimately approximately neutral pH.

In a preferred embodiment of the invention the latent image is formed with an indicator dye. The indicator dye preferably has a pKa of from about 10 to about 13 and also preferably is one which decolorizes completely at neutral pH. Accordingly, in this preferred embodiment there is provided a transient visible image which can be seen by an observer as the visible image of the object of the exposure is developing and which then disappears.

In another preferred embodiment of the invention the latent image is formed with a bleachable indicator dye. Bleachable indicator dyes and their use in photography, including diffusion transfer photographic film units, are well known. See, for example, U.S. Pat. Nos. 4,139,381; 4,178,446 and 4,178,447. A bleachable indicator dye is typically colorless at low pH, e.g., neutral pH, becomes colorized at high pH, e.g., pH 12–13, and will bleach, or decolorize, irreversibly by hydrolysis when maintained at high pH for a period of time. The combination of an indicator dye moiety and a bleachable dye moiety in one molecule allows the initiation of the process to provide a visual image from the latent image to be pH-dependent whereas the completion of this process is hydrolysis-dependent. Accordingly, the time that the image obtained from the latent image remains visible can be independent of the pH drop in the development process. A particularly preferred bleachable indicator dye for use according to the invention is 3,3-bis (4-hydroxy-3,5-dimethoxyphenyl)- 1,2-benzisothiazole-2 (3H)-carboxylic acid-1,1-dioxide, 2-(methylsulfonyl) ethyl ester.

Bleachable filter dyes comprise another preferred class of compounds for froming a latent image according to the invention. A bleachable filter dye typically is colored at low pH, e.g., neutral pH, and decolorizes by hydrolysis at high pH, e.g., pH 12–13. These compounds may be used to provide a visible image corresponding to the latent image. Since bleachable filter dyes are colored at low pH, it is preferred to incorporate the latent image formed with these compounds in the film unit in a location such that exposure of the photosensitive element to an object is not made through the latent image.

Diffusion transfer film units typically are made by initially manufacturing separate photosensitive and image-receiving elements and subsequently assembling these, together with a rupturable container containing the aqueous alkaline processing composition, to form the complete film unit. The latent image can be formed in any suitable location within the film unit, i.e., in the photosensitive element and/or in the image-receiving element. It is preferred to provide the latent image in the image-receiving layer of the image-receiving element.

The latent image can be formed in the film unit during the manufacture of the photosensitive or image-receiving elements or during assembly of the film unit. A solution of the image-forming chemical compound in a solvent such as an alcohol, ketone or ester is typically formed and applied in an imagewise pattern at the desired location within the film unit. The concentration of the chemical compound can be selected to provide the density desired for the visible image which results from the latent image. Routine scoping tests can be conducted to determine the concentration which is optimum to provide the desired result in any particular film unit. In the case of the preferred indicator dyes an approximately 2% (by weight) solution of the dye in an organic solvent such as isopropyl alcohol will provide the desired result.

An optical brightener material can be incorporated in the solution used to form the latent image . Thus, examination of the film unit with an ultraviolet light source can be carried out to verify that the latent image has been properly formed.

According to another preferred embodiment, a latent image such as a message can be incorporated in a permanent $D_{min}$, or background, area of the film unit by pre-exposing the area to light during manufacture of the photosensitive element or assembly of the film unit. The latent image can be formed in the pre-exposed area with a chemical material which will provide a permanent image such as an indicator dye which does not decolorize at neutral pH. In this manner there is provided a composite image of the object to which the film unit is exposed together with the visible image formed from the latent image.

As stated previously, the diffusion transfer photographic film units of the invention may be peel-apart or integral. The photographic products and methods of the diffusion transfer type are well known in the art and are described in detail in numerous patents. The arrangement and the order of the individual layers of the film units and many materials suitable for use therein are known in the art. Accordingly, extensive discussion of such materials and film units is not required here.

Generally, various embodiments of peel-apart diffusion transfer film units are known and include those wherein images are formed in black and white (reduced silver) and color (image dyes) as described in E. H. Land, H. G. Rogers and V. K. Walworth in Neblettes Handbook of Photography and Reprography, 7th Edition, J. M. Sturge, editor, Van Nostrand Reinhold, New York 1977, pp 258–330; and V. K. Walworth and S. H. Mervis in Imaging Processes and Materials, Neblettes Eighth Edition, J. Sturge, V. Walworth and A. Shepp, editors, Van Nostrand Reinhold, New York, 1989, pp 181–225. Additional examples of peel-apart film units are described in U.S. Pat. Nos. 2,983,606; 3,345,163; 3,362,819; 3,594,164; 3,594,165 and 5,593,809. Black and white film units according to the invention can be provided in both the peel-apart and integral formats as described, for example, in U.S. Pat. Nos. 2,543,181; 4,489,152 and 5,858,608. All the foregoing references are incorporated by reference herein. Indicator dyes which are colorless at neutral pH are preferred for forming latent images in peel-apart film units according to the invention where a transient visible image corresponding to the latent image is desired, since the photosensitive and image-receiving elements are separated from one another at relatively high pH where the transient image is visible and as the pH in the image-receiving member drops to neutral the transient image will disappear.

A preferred embodiment according to the invention comprises an integral film unit which is exposed, and the image formed viewed, through the same surface such as is described in U.S. Pat. No. 3,415,644 which is incorporated by reference herein. In commercial embodiments of this type of film unit e.g., SX-70 film from Polaroid Corporation, the support for the photosensitive element is opaque, the support for the image-receiving element is transparent and a light-reflecting layer against which the image formed in the image-receiving element is viewed is formed by distributing a layer of processing composition containing a light-reflecting pigment such as, for example, titanium dioxide, between the super posed elements. By also incorporating suitable pH-sensitive optical filter agents, preferably pH-sensitive phthalein dyes, in the processing composition as described in U.S. Pat. No. 3,646,347 which is incorporated by reference herein, the film unit may be ejected from the camera immediately after the processing composition has been applied such that the development process is completed in ambient light while the photographer watches the transfer image emerge.

In integral film units of the foregoing type where a transient visible image corresponding to the latent image is desired, it is preferred to form the latent image with a bleachable indicator dye. Since the bleachable indicator dye will become colored at high pH and then decolorize by hydrolysis when maintained at that pH for a period of time, the visible image corresponding to the latent image will be seen by an observer but will disappear before the system pH drops to neutral.

In a particularly preferred embodiment the multicolor photosensitive element is of the type described in U.S. Pat. No. 4,740,448, which is incorporated by reference herein, although any of the known types of multicolor diffusion transfer photosensitive elements may be utilized. The image-receiving element may be any of those known for use in diffusion transfer photographic film units. In a preferred embodiment the image-receiving element comprises a transparent support carrying a polymeric acid-reacting layer, a timing, or spacer, layer and an image receiving layer.

As is well known in the art the processing composition is applied to the film unit typically by passing the film unit through a pair of opposed spread rollers which cause the rupturable container to rupture in the desired predetermined edge whereby the processing composition is spread uniformly throughout the picture area of the film unit. The film unit typically includes a mask sheet which has a rectangular aperture formed therein which ultimately will frame the resulting picture formed in the image-receiving element because of the parallel side rails on each side of the film unit in the processing composition spreading direction and the opposed leading and trailing edge masking areas. For a detailed description of a mask layer structure see, for example, U.S. Pat. No. 4,824,761 which is hereby incorporated by reference herein. The processing composition flows into a chamber formed by the side rails and the layers or elements of the film unit between which it is desired to deposit the processing composition. The thickness of the side rails determines the spacing between the layers or elements of the film unit where the processing composition is spread such that a predetermined thickness of a coating of the processing composition is applied. Thus, to facilitate the maintaining of a substantially uniform thickness of a coating of the processing composition the adhesive layer preferably extends, in the processing composition spreading direction, beyond the picture area. In the direction perpendicular to the processing composition spreading direction the adhesive layer extends beyond at least a substantial portion of the width of the rails, e.g., overlaps preferably about one-half to three quarters of the rail width.

A preferred embodiment of a film unit according to the invention, is one which is exposed and viewed through opposing outer surfaces. Diffusion transfer photographic film units of the type where exposure is made through one transparent outer surface and the image formed is viewed through the opposing outer surface are well known in the art and are described in detail for example in U.S. Pat. Nos. 3,594,165 and 3,689,262 which are incorporated by reference herein. In this type of film unit there are coated on one transparent support both the image-receiving and photosensitive elements and a transparent sheet element is arranged on the photosensitive element so as to form the other of the outer surfaces of the unit.

The photosensitive elements of the film units comprise a photosensitive silver halide emulsion. In a preferred color embodiment of the invention, the photosensitive silver halide emulsion includes a corresponding diffusible dye, which upon processing is capable of diffusing to the image-receiving layer as a function of exposure. In a preferred "black & white" embodiment of the invention, the image-forming material utilized is complexed silver which diffuses from the photosensitive element to the image-receiving layer during processing. Both such photosensitive systems are well known in the art and will be described in more detail hereinafter.

Particularly preferred film units according to the invention are those intended to provide multicolor dye images. The most commonly employed negative components for forming multicolor images are of the "tripack" structure and contain blue-, green-, and red-sensitive silver halide emulsion layers, each having associated therewith in the same or in a contiguous layer a yellow, a magenta and a cyan image dye-providing material, respectively. Suitable photosensitive elements and their use in the processing of diffusion transfer photographs are well known and are disclosed, for example, in U.S. Pat. No. 3,345,163 (issued Oct. 3, 1967 to E. H. Land, et al.); in U.S. Pat. No. 2,983,606 (issued May 9, 1961 to H. G. Rogers); and in U.S. Pat. No. 4,322,489 (issued Mar. 30, 1982 to E. H. Land, et al.). Photosensitive elements which include dye developers and a dye-providing thiazolidine compound can be used with good results and are described in U.S. Pat. No. 4,74Q,448 to P. O. Kliem.

In black and white film unit embodiments, a photosensitive element including a photosensitive silver halide emulsion is exposed to light and subject to an aqueous alkaline solution comprising a silver halide developing agent and a silver halide solvent. The developing agent reduces exposed silver halide to metallic silver and the solvent reacts with un-reduced silver halide to form a soluble silver salt complex. This soluble silver salt complex migrates to an image-receiving element. The image-receiving element typically comprises a support and an image-receiving layer including a silver precipitating material wherein the soluble silver salt complex is precipitated or reduced to form a visible silver "black and white" image. The binder material for the overcoat layer in black and white embodiments should be permeable to the photographic alkaline processing fluid and to complexed silver salt which transfers to the image-receiving layer to provide an image. Examples of such black and white photographic film units are disclosed in U.S. Pat. Nos. 3,567,442; 3,390,991; and 3,607,269 and in E. H. Land, H. G. Rogers, and V. K. Walworth, in J. M. Sturge, ed., *Neblette's Handbook of Photography and Reprography*, 7th ed., Van Nostrand Reinhold, New York, 1977, pp. 258–330.

The invention will now be further described with respect to specific preferred embodiments by way of examples, it being understood that these are intended to be illustrative only and the invention is not limited to the materials, conditions, process parameters, etc. recited therein. All parts and percentages recited are by weight unless otherwise stated.

EXAMPLE

The integral diffusion transfer film unit used in the example had the following structure: the photosensitive element comprised an opaque subcoated polyethylene terephthalate photographic film base carrying in succession:

1. Polymeric Acid coated at 22,300 mg/m$^2$ comprising a 1/1 copolymer of acrylic acid/butyl acrylate described in U.S. Pat. No. 5,427,899 and about 60 mg/ft$^2$ carbon black.

1a. A polymeric acid layer comprising from about 6456 mg/m$^2$ of a partial butyl ester of ethylene maleic anhydride, about 1076 mg/m$^2$ of polyvinyl butyral, and about 23 mg/m$^2$ of titanium dioxide;

2. A timing layer comprising a 49.1/30/10/3.7/7.2 pentapolymer of: butylacrylate/diacetone acrylamide/carbomethoxy methyl acrylate/methylacrylic acid/methylmethacrylate coated at a coverage of about 2600 mg/m$^2$, and a quantity of sodium hydroxide sufficient to impart a pH to the layer of about 7.2.

3. a cyan dye developer layer comprising about 500 mg/m$^2$ of the cyan dye developer represented by the formula

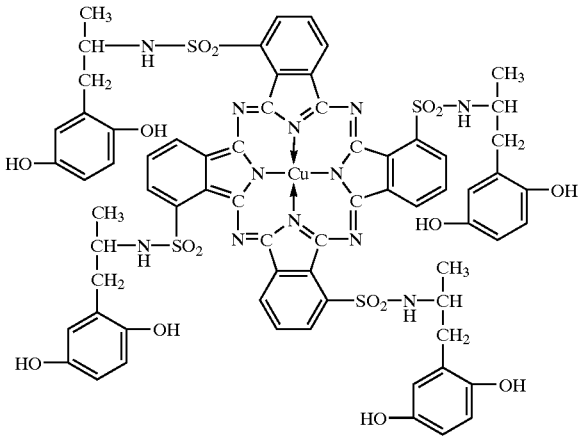

about 274 mg/m$^2$ of gelatin;

4. an interlayer comprising about 800 mg/m$^2$ of titanium dioxide, about 374 mg/m$^2$ of a dispersion of polymethylmnethacrylate beads (about 0.2 $\mu$m), about 124 mg/m$^2$ of gelatin, and about 374 mg/m$^2$ of a copolymer of butyl acrylate/diacetone acrylamide/methacrylic acid/styrene/acrylic acid;
5. a red-sensitive silver iodobromide layer comprising about 240 mg/m$^2$ of silver iodobromnide (1.1 $\mu$m), about 420 mg/m$^2$ of silver iodobromide (1.5 $\mu$m), about 540 mg/m$^2$ of silver iodobromide (1.8 $\mu$m) and about 600 mg/m of gelatin;
6. a layer including MPHQ at 120 mg/m$^2$, ascorbyl palmitate at 1–5 mg/m$^2$, tricrestylphosphate at about 200 mg/ft$^2$, and gelatin at 1200 mg/m$^2$;
7. an interlayer comprising about 4010 mg/m$^2$ of a copolymer of butyl acrylate/diacetone acrylamide/methacrylic acid/styrene/acrylic acid and 170 mg/m$^2$ polyacrylamide;
8. a magenta dye developer layer comprising about 300 mg/m$^2$ of a magenta dye developer represented by the formula

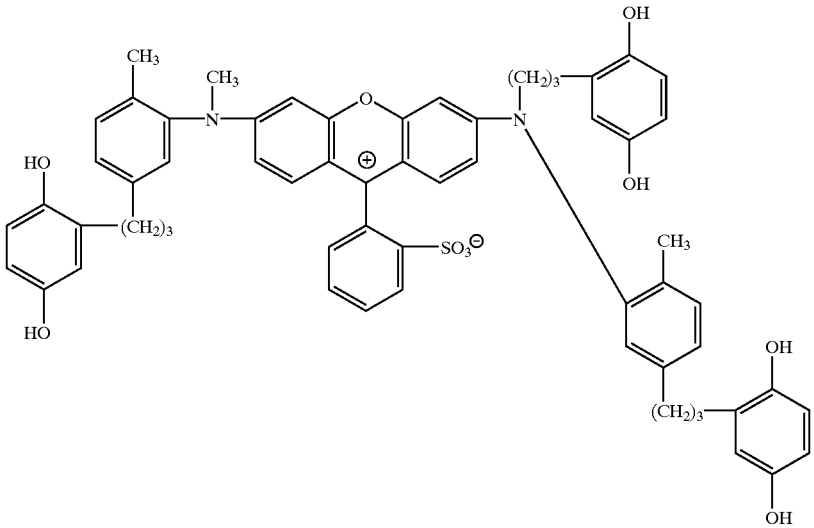

about 30 mg/m$^2$ of benzylaminopurine, about 200 mg/m$^2$ of a releasable antifoggant

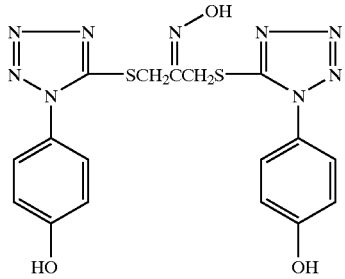

about 200 mg/m$^2$of 2-phenyl benzimidazole and about 292 mg/m$^2$ of gelatin;

9. a layer comprising about 900 mg/m$^2$ of titanium dioxide, about 337 mg/m$^2$ of a dispersion of polymethylmethacrylate beads (about 0.2 $\mu$m), about 112 mg/m$^2$ of gelatin and about 337 mg/m$^2$ a copolymer of butyl acrylate/diacetone acrylamide/methacrylic acid/styrene/acrylic acid;
10. a green-sensitive silver iodobromide layer comprising about 1000 mg/m$^2$ of silver iodobromide (1.3 $\mu$m) and about 484 mg/m$^2$ of gelatin;
11. a spacer layer comprising about 300 mg/m$^2$ tricresylphosphate, about 136 mg/m$^2$ of MPHQ, about 136 mg/m$^2$ of a lactone developer represented by the formula

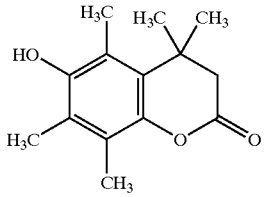

and about 249 mg/m$^2$ of gelatin;

12. an interlayer comprising about 1248 mg/m$^2$ of a copolymer of butyl acrylate/diacetone acrylamide/ methacrylic acid/styrene/acrylic acid, and 52 mg/m$^2$ polyacrylamide;

13. a layer comprising about 1200 mg/m$^2$ of a scavenger (1-octadecyl-4,4-dimethyl-2-[2-hydroxy-5-(N-(7-caprolactamido)sulfonamido-phenyl] thiazolidine) and about 696 mg/m$^2$ of gelatin;

14. a yellow filter layer comprising about 400 mg/m$^2$ of a benzidine yellow dye, about 400 mg/m$^2$ of a polyvinylalcohol (Airvol® 325, available from Air Products Co.) and about 150 mg/m$^2$ of a hardener (available from R. H. Sands Corp. under the tradename OB 1207);

15. a yellow image dye-providing layer comprising about 420 mg/m$^2$ of a yellow image dye-providing material represented by the formula

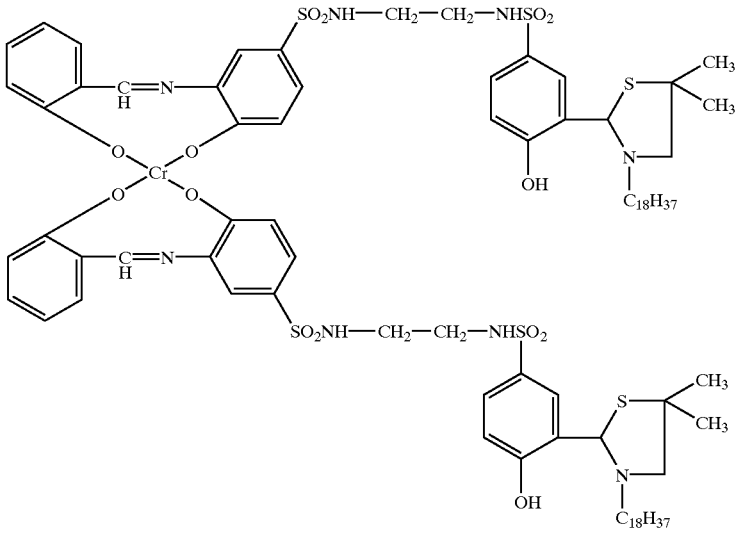

dispersed in Airvol, and about 280 mg/m$^2$ of gelatin;

16. a layer coated at a coverage of about 412 mg/m$^2$ of a tert-octylhydroquinone, about 206 mg/m$^2$ of dimethylterephthalamide, about 45 mg/m$^2$ of an oxidative release restrainer compound (available from Fairmont Chemical, Inc.) and about 300 mg/m$^2$ of gelatin;

17. a blue-sensitive silver iodobromide layer comprising about 235 mg/m$^2$ of silver iodobromide (1.3 $\mu$m) and about 118 mg/m$^2$ of gelatin; and 18. a layer comprising about 450 mg/m$^2$ of a dispersion of polymethylmethacrylate beads (about 0.2 $\mu$m), and about 350 mg/m$^2$ of gelatin.

The image-receiving element comprised a transparent subcoated polyethylene terephthalate photographic film base carrying in succession:

1. an image-receiving layer coated at a coverage of about 2798 mg/m$^2$ comprising 2 parts of a terpolymer comprising vinylbenzyltrimethylammonium chloride, vinylbenzyltriethylammonium chloride and vinylbenzyldimethyldodecyl-ammonium chloride (6.7/3.3/1 weight %, respectively) and 1 part of gelatin, about 12.5 mg/m$^2$ of dimethyl-2,4-imidazolinedione, about 53.8 mg/m$^2$ of ammonium nitrate and about 10.8 mg/m$^2$ of polymethylmethacrylate beads (available from Anitec Image, from about 4 $\mu$m to about 7 $\mu$m);

2. a layer coated at a coverage of about 810 mg/m$^2$ comprising about 540 mg/m$^2$ of Igepal® CO-997 and about 270 mg/m$^2$ of Type NP K-90; and 3. a layer coated at a coverage of about 430 mg/m$^2$ comprising about 323 mg/m$^2$ of Petrolite® (D300) and about 108 mg/m$^2$ of Polyox N3K, a ratio of about 3:1, respectively, and about 21.5 mg/m$^2$ of 0.1% of Aerosol-OS.

A latent image according to the invention was applied to the outer surface of the image-receiving element by initially forming an approximately 2% (by weight) solution of thymolphthalein (TMP) in isopropyl alcohol. A rubber stamp bearing the image of a happy face was dipped into the solution and two images of the happy face were applied to the outer surface of the film base of the image-receiving element by pressing the stamp twice against the outer surface of the base. The images were dried with a dryer.

A rupturable container containing an aqueous alkaline processing composition was affixed between the image-receiving and photosensitive elements at the leading edge of the film unit such that the application of compressive pressure to the container would rupture the seal of the container along its marginal edge and distribute the contents uniformly between the respective elements. The chemical composition of the aqueous alkaline processing composition utilized for the processing of the film unit is set forth in TABLE I.

TABLE I

| COMPONENT | PARTS BY WEIGHT |
|---|---|
| optical filter agent[1] | 1.10 |

TABLE I-continued

| COMPONENT | PARTS BY WEIGHT |
|---|---|
| 4-methyl-benzenesulfinic acid | 1.00 |
| 6-methyluracil | 0.59 |
| hydrophobically modified polyacrylic acid | 1.20 |
| trans-4-(aminoethyl) cyclohexane carboxylic acid | 0.15 |
| 2-amino-1,7-dihydro-6H-purine-6-one | 0.25 |
| potassium hydroxide | 5.92 |
| silica, aqueous dispersion | 0.31 |
| 1-(4-hydroxyphenyl)-2-tetrazoline-5-thione | 0.02 |
| inosine | 0.25 |
| optical filter agent[2] | 0.13 |
| 1-(phenyl-N-propyl)-2-ethylpyridinium bromide, 50% aqueous solution | 0.07 |
| 1H-1,2,4-triazole | 0.18 |
| 2-ethyl-1-(2-dioxanylethyl)pyridinium bromide, 50% aqueous solution | 1.06 |
| titanium dioxide | 42.0 |
| hypoxanthine | 0.76 |
| 2-ethyl-1H-imidazole | 1.68 |
| optical filter agent[3] | 0.11 |
| water | balance to 100 |

1

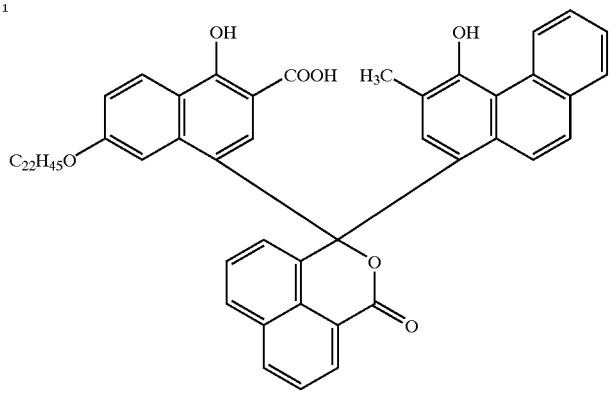

2

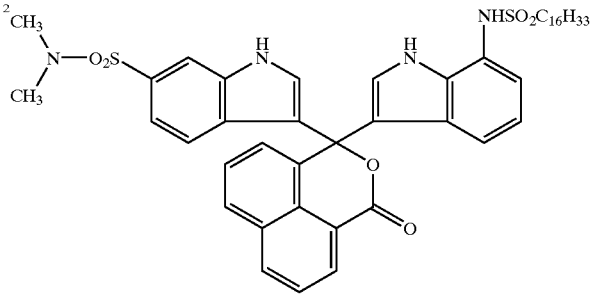

3

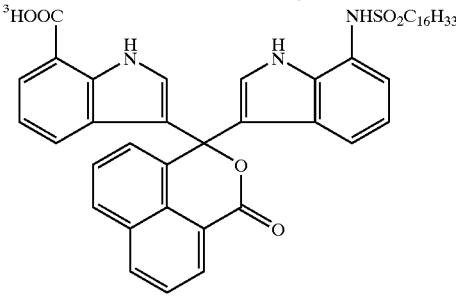

The film unit was then exposed to a $D_{max}/D_{min}$ step target which had one clear side and one opaque side and the film unit was then passed through a pair of opposed spread rollers to distribute the processing composition across the film unit. A happy face image was observed on both sides of the film unit, i.e., in both the exposed and unexposed areas of the film unit. After about nine minutes from the initiation of the development process both happy face images disappeared.

Although the invention has been described in detail with respect to various preferred embodiments it is not intended to be limited thereto, but rather those skilled in the art will recognize that variations and modifications may be made which are within the spirit of the invention and the scope of the appended claims.

What is claimed is:

1. A diffusion transfer photographic film unit comprising a photosensitive element comprising a support carrying at least one silver halide emulsion layer;

a second sheet-like element which is in superposed relationship or adapted to be placed in superposed relationship with said photosensitive element;

an image-receiving layer positioned in one of said photosensitive and second sheet-like elements;

means providing an aqueous alkaline processing composition for distribution between predetermined layers of said elements, and a latent image carried by at least one of said photosensitive and second sheet-like elements, said latent image comprising a chemical compound capable of forming a visible image upon contact with said aqueous alkaline processing composition, said chemical compound not being exposed silver halide.

2. The diffusion transfer film unit as defined in claim 1 wherein said latent image comprises a chemical compound selected from the group consisting of indicator dyes, bleachable indicator dyes and bleachable filter dyes.

3. The diffusion transfer film unit as defined in claim 1 wherein said latent image is carried by said imaging receiving layer.

4. The diffusion transfer film unit as defined in claim 1 wherein said photosensitive element comprises a support carrying at least two different color image components, each of said color image components including a color-sensitive silver halide emulsion in association with a corresponding image dye-providing material.

5. The diffusion transfer film unit as defined in claim 4 which includes a red-image component comprising a red sensitive silver halide emulsion layer in association with a cyan image dye-providing material, a green image component comprising a green-sensitive silver halide emulsion layer in association with a magenta image dye-providing material and a blue image component comprising a blue-sensitive silver halide emulsion layer in association with a yellow image dye-providing material.

6. The diffusion transfer film unit as defined in claim 1 further including means providing a light-reflecting layer against which an image in said image-receiving layer may be viewed and wherein said second sheet-like element further includes a support and said image-receiving layer is positioned in said second sheet like element.

7. The diffusion transfer film unit as defined in claim 6 wherein said support of said second sheet-like element is transparent and said support of said photosensitive element is opaque.

8. The diffusion transfer film unit as defined in claim 7 wherein said latent image is carried by said image-receiving layer and comprises a bleachable indicator dye.

9. The diffusion transfer film unit as defined in claim 6 wherein said support of said second sheet-like element is opaque, said means providing a light-reflecting layer is a layer of light-reflecting pigment positioned between said image-receiving layer and said opaque support of said second sheet-like element and said second sheet-like element is adapted to be separated from said photosensitive element after an image is formed in said image-receiving layer.

10. The diffusion transfer film unit as defined in claim 9 wherein said latent image is carried by said image-receiving layer and comprises an indicator dye.

11. The diffusion transfer film unit as defined in claim 1 wherein said means providing an aqueous alkaline processing composition comprises a rupturable container releasably holding said aqueous alkaline processing composition.

12. The diffusion transfer film unit as defined in claim 1 wherein said latent image is adapted to form a transient visible image as a result of photographic development.

13. The diffusion transfer film unit as defined in claim 1 wherein said latent image is adapted to form a permanent image as a result of photographic development.

14. A diffusion transfer photographic method comprising exposing a film-unit as defined in claim 1 to an object and distributing said aqueous alkaline processing composition between predetermined layers of said film unit whereby there are provided as a result of photographic development a visible image corresponding to said latent image and a visible image corresponding to said object.

15. The diffusion transfer photographic method as defined in claim 14 wherein said visible image corresponding to said latent image is transient.

16. The diffusion transfer photographic method as defined in claim 14 wherein said visible image corresponding to said latent image is permanent.

* * * * *